United States Patent [19]

Williams

[11] Patent Number: 4,495,846

[45] **Date of Patent: * Jan. 29, 1985**

[54] ELECTRONIC MUSICAL INSTRUMENT

[76] Inventor: S. Keith Williams, 1432 Cleveland St., Evanston, Ill. 60202

[ * ] Notice: The portion of the term of this patent subsequent to Nov. 29, 2000 has been disclaimed.

[21] Appl. No.: 168,713

[22] Filed: Jul. 14, 1980

Related U.S. Application Data

[63] Continuation-in-part of Ser. No. 851,444, Nov. 14, 1977, abandoned.

[51] Int. Cl.[3] ..... G10H 7/00

[52] U.S. Cl. ..... 84/1.01; 84/1.24; 84/DIG. 10

[58] Field of Search ..... 84/1.01, 1.03, 1.11–1.13, 84/1.19–1.27, DIG. 2, DIG. 8, DIG. 10

[56] References Cited

U.S. PATENT DOCUMENTS

| | | | |
|---|---|---|---|
| 3,534,144 | 10/1970 | Ring | 84/1.01 |
| 3,610,799 | 10/1971 | Watson | 84/1.01 |
| 3,743,755 | 7/1973 | Watson | 84/1.01 |
| 3,844,379 | 10/1974 | Tomisawa et al. | 84/1.01 |
| 3,916,750 | 11/1975 | Uetrect | 84/1.01 |
| 4,114,497 | 9/1978 | Hiyoshi et al. | 84/1.01 X |
| 4,131,049 | 12/1978 | Okumura et al. | 84/1.01 |
| 4,133,244 | 1/1979 | Hiyoshi et al. | 84/1.26 |
| 4,134,321 | 1/1979 | Woron | 84/DIG. 2 |
| 4,147,085 | 4/1979 | Robinson et al. | 84/1.01 X |
| 4,217,804 | 8/1980 | Yamaga et al. | 84/1.03 |
| 4,235,142 | 11/1980 | Nakada et al. | 84/1.03 |
| 4,238,985 | 12/1980 | Adachi | 84/1.01 |
| 4,244,260 | 1/1981 | Kniepkamp et al. | 84/1.19 X |
| 4,259,888 | 4/1981 | Gross | 84/1.24 X |
| 4,333,375 | 6/1982 | Sogoh | 84/1.01 |

*Primary Examiner*—Stanley J. Witkowski

[57] ABSTRACT

An electronic musical instrument is provided in which frequency signals are developed by voltage controlled oscillators which are controlled from an analog demultiplexer connected to a scanner of a keyboard and control circuit and in which envelope signals are developed by an envelope synthesizer in synchronized relation to the frequency signals, such frequency and envelope signals being applied to a waveform synthesizer circuit to develop output signals for production of tones. The keyboard and control circuit includes available oscillator and keyboard memories operable from a memory interchange circuit and further includes circuitry for accommodating overload, re-key and an optional portamento operation which is polyphonic in that the frequencies of a plurality of tones can be simultaneously and continuously changed. The circuitry also provides an infinite duration release capability. The envelope synthesizer cooperates with the keyboard and control circuit in such operation and is readily adjusted to obtain desired envelope characteristics. The waveform synthesizer includes analog multiplexer means controlled from a plurality of voltage levels which may preferably be established by potentiometers having linearly movable controls.

18 Claims, 11 Drawing Figures

TO VCO'S
91
91
O
90
ANALOG DEMULTIPLEXER
PORT. CONTROL
88
89
111
I
87
110
C
76
77
109
TO ENV. FIG. 9
KEYBOARD MEMORY
O
101D
COMPARE
I
LIFO MEMORY
A
O
W
E
78a
78b
78
78c
PU
PO
78d
95
LE
48
CLOCK
MEMORY INTERCHANGE CONTROL
79
49
81
82a
82b
82
84
113
45
119
TO ENV.
KEYBOARD COUNTER
EDS
OVERLOAD PORTAMENTO & RE-KEY CIRCUIT (FIG. 5 & 5a)
R
O
100
66 or 66a
64 or 64a
69 or 69a
46
105 FIG. 9
50
KEYBOARD CIRCUIT (FIG. 3 or FIG. 4)
62 or 62a

TO MEMORY INTERCHANGE CONTROL

INITIATE
NULL
95
81
82
45
94
118
119
RE-KEY FLIP FLOP
O
D
96
120
115
RESET DIS-ABLE FLIP FLOP
92
Z CK
121
SEE FIG. 2.
46
102
D
S
Z CK
93
101
104
105
PORT FLIP FLOP
O
S
114
97
98
SEARCH SCAN FLIP FLOP
107
108
99
100
CK Z
103
112
109
113
66
64 or 64a
69 or 69a
INITIATE
KEY DOWN
RELEASE
FROM FIGS. 3 OR 4

FROM FIG. 3 or 4

ELECTRONIC MUSICAL INSTRUMENT

This application is a continuation-in-part of application Ser. No. 851,444, filed Nov. 14, 1977, and now abandoned.

This invention relates to an electronic musical instrument and more particularly to a polyphonic electronic musical instrument which uses multiplexing in a manner such as to minimize the complexity of wiring and the number of required components so as to minimize the cost and manufacture and which is readily controllable to produce desired waveforms and tone qualities and also to produce the desired envelope of each tone produced. This polyphonic instrument has a voltage-controlled modular structure similar to that of existing monophonic music synthesizers.

BACKGROUND OF THE PRIOR ART

Multiplex systems are, of course, commonly used in telephone systems for selecting and forming transmission channels between subscribers' lines and similar types of systems have been heretofore proposed for musical systems, using multiplexing for the generation of tones from the operation of keyboard switches. One such system is disclosed in the Watson U.S. Pat. No. 3,610,799, issued Oct. 5, 1971 in which a digital decoder and a switching array are used in conjunction with an encoder to develop a time division multiplex signal in the form of a serial output signal on a single conductor emanating from the encoder. The serial output signal so developed contains assignments of the notes which are associated with depressed keys. The Watson patent also discloses the use of a digital multiplex arrangement wherein information in serial digital form is used for the selection of generator circuits for generating tones by the use of digital techniques, the tones having wave shapes controlled from a time-shared read-only memory and register and calculator circuits. With such a system, there is a possiblity of eliminating or reducing the number of certain components and in reducing the complexity of wiring as used in prior systems, but from a practical standpoint, the implementation of the system to provide an instrument which is both operative and readily controlled involves the design and construction of complex digital circuits and would appear to be difficult and expensive.

The Rossum U.S. Pat. No. 3,986,423 issued Oct. 19, 1976 provides another prior art disclosure of a musical instrument or synthesizer in which multiplexing is employed. The Rossum patent discloses a system using digital multiplexing and having a plurality of channel circuits each of which includes a voice controlled oscillator controlled from a sample and hold circuit, the sample and hold circuits of all channels having inputs connected to the output of a digital-to-analog converter. Signals are applied to the digital-to-analog converter from the output of a read-only memory to which address signals are applied in synchronism with the scanning of a keyboard. Strobe signals are applied to the sample and hold circuits from comparison circuits in the respective channel circuits, each comparison circuit being operative to compare the signal applied from the address counter currently with that applied in a previous cycle and stored in a storage register. Channel selection logic is used to control the relationship between the channel circuits and actuated keys, by controlling the signals initially applied to the storage registers. The number of channels may be much less than the number of keys in the keyboard.

There are many other disclosures in the prior art relating to the use of multiplexing in musical instruments, the generation of desired wave shapes and the control of the envelope of a sound produced in response to each actuation of a key of a keyboard.

The White U.S. Pat. No. 3,006,228 issued Oct. 31, 1961 discloses a circuit for use in musical instruments in which the outputs of a series of frequency dividers are combined through gate circuits and switches to produce tones having desired tonal qualities.

The Cordry U.S. Pat. No. 3,297,812 issued Jan. 10, 1967 discloses an electric organ having single contact key switches and having function switches operable to determine the pitch of tones to be reproduced with a plurality of "And" gates equal in number to the number of key switches and to the number of function switches.

The Munch U.S. Pat. No. 3,417,188 issued Dec. 17, 1968 discloses a preference circuit for electronic musical instruments using pulse amplitude discrimination and a zero-crossing detector.

The Deutsch U.S. Pat. No. 3,515,792 issued June 2, 1970 discloses a digital organ in which wave shapes to be reproduced are stored in digital form in a memory in the form of a diode array which is scanned by means including ring counters to each of which a clock signal is applied at a frequency equal to a predetermined multiple (48) of the frequency of the tone to be reproduce. The Deutsch patent also discloses attack and decay control circuitry and also a frequency synthesizer in which notes such as C tones are produced from an oscillator through a series of cascaded divide-by-two circuits. B tones are produced in such similar fashion from a multivibrator controlled from a circuit which compares its output frequency divided by 185 with the output of the C tone oscillator divided by 196. B flat or A sharp is produced in a similar fashion from B natural, and so on.

The Arsem et al U.S. Pat. No. 3,696,201 issued Oct. 3, 1972 discloses a digital organ in which pulse producing means are controlled from key switches to produce repeating trains of pulses at repetition rates determined by the keys, such pulse trains being applied to a boxcar integrator to produce an audio tone.

The Deutsch U.S. Pat. No. 3,697,661 issued Oct. 10, 1972 discoses a multiplexed pitch generator system in which the function of mechanical intermanual couplers of conventional organs is performed electronically, using a plurality of shift registers and coincidence comparison circuitry.

The Reinagel U.S. Pat. No. 3,733,955 issued May 22, 1973 discloses a synthesizer keyboard arrangement wherein a single resistance string is used in independently controlling the frequencies of two voltage controlled oscillators at the same time.

The Colin U.S. Pat. No. 3,828,110 issued Aug. 6, 1974 discloses control circuitry for controlling a voltage controlled oscillator and an envelope generator from a keyboard and voltage divider circuit, a sample-and-hold circuit being provided.

The Nakajima U.S. Pat. No. 3,836,692 issued Sept. 17, 1974 discloses signal selecting system for an instrument having memory means and tone signal sources corresponding to one octave, frequency divider means coupled to the tone signal sources, preference circuit means and octave selecting means.

The Tomisawa U.S. Pat. No. 3,882,751 issued May 13, 1975 discloses an electronic musical instrument employing wave shape memories and also a frequency information memory and memories for control of the form of the envelopes of tones produced. The memories are controlled from a key assignor which includes a key address code memory which is capable of storing key address codes up to the same number as a maximum number of musical tones to be simultaneously reproduced, twelve channels being used in the illustrated embodiment. Shift registers are provided in the key assignor means and wave shape generating means and envelope wave shape generating means which have a number of stages corresponding to the number of channels and which are driven in synchronism.

The Morez et al U.S. Pat. No. 3,902,397 issued Sept. 2, 1975 discloses an electronic musical instrument including a couples control unit for shifting the position of pulses within a train of pulses which are encoded in time position in response to operation of keys and also for individually controlling the amplitude of pulses within the train. Sample and hold units are provided, one for each of the switches in one of a group of switches such as groups of upper manual, lower manual and pedal switches.

The Deutsch U.S. Pat. No. 3,929,053 issued Dec. 30, 1975 discloses a circuit arrangement for production of glide and portamento, wherein a generated tone has a frequency proportional to a number of digital form, such number being modified in increments through divider, adding and accumulator circuits.

The Southard U.S. Pat. No. 3,955,468 issued May 11, 1976 discloses an electronic musical instrument using digital multiplexed signals and having a plurality of keyboards with an arrangement for scanning the key switches in both keyboards simultaneously and for developing a corresponding digital signal.

The Sakashita U.S. Pat. No. 3,977,290 issued Aug. 31, 1976 discloses a circuit for generating a signal at the correct frequency to produce a musical tone, using a pulse counter having a variable frequency dividing ratio and a ratio-setting signal-generating circuit.

The Oya U.S. Pat. No. 3,981,217 issued Sept. 21, 1976 discloses a key assigner circuit in which instead of scanning key switches, changes in the conditions thereof are simultaneously and parallelly delivered therefrom.

The Obayashi et al U.S. Pat. No. 3,982,460 issued Sept. 28, 1976 discloses a circuit for producing a musical tone waveform in which the waveform to be reproduced is sampled at sampling points determined from the intersection with dividing lines at equal amplitude intervals, the time intervals between adjacent sampling points being thus variable. Information as to each sampling point is entered into a memory as a digital signal. Additional features relate to the development of digital signals corresponding to the increase, decrease or equality at each sampling point with respect to a preceding sampling point and to a provision of an envelope setting arrangement in which the envelope desired to be reproduced is subjected to sampling with the analog of each sampling point being set up as a digital signal.

The Kugisawa U.S. Pat. No. 3,982,461 issued Sept. 28, 1976 discloses an arrangement similar to that of the Obayashi U.S. Pat. No. 3,982,460 and is directed primarily to the generation of increase, decrease or equality signals from comparison of signals from sampling points to those from preceding sampling points and also to envelope setting means.

SUMMARY OF THE INVENTION

In accordance with this invention, an electronic musical instrument is provided in which frequency signal and envelope signal generator means are controlled from a keyboard and control circuit to develop frequency signals which define the frequencies of the fundamental frequency components of tones to be produced and to develop envelope signals having amplitudes varying according to envelope functions of tones to be produced, such signals being applied to a waveform synthesizer circuit to develop output signals for production of tones. The frequency signals may be developed by voltage controlled oscillators to which analog signals are applied from an analog demultiplexer which responds to an output signal developed by a scanner in the keyboard and control circuit. With this arrangement, tones having desired waveforms and envelope characteristics are produced with a much fewer number of components and much simpler wiring than is required in prior art types of circuits In accordance with a specific feature of the invention, the keyboard and control circuit includes an available oscillator memory which contains the addresses of available voltage controlled oscillators, a keyboard memory containing key addresses and an interchange control which transfers information from the available oscillator memory to the keyboard memory and back again in response to initiation and termination of key select signals. Preferably, the available oscillator memory is a last-in-first-out stack memory.

In accordance with another specific feature of the invention, the keyboard and control circuit includes a portamento arrangement which may be used as desired and which is such that gradual changes in the amplitudes of a plurality of analog signals are developed in response to successive key actuation in a manner such as to produce gradual changes in the frequencies of tones produced. In portamento operation, capacitors at the inputs of the voltage controlled oscillators are gradually charged or discharged through a resistor provided in series between the analog demultiplexer and the voltage controlled oscillators.

The portamento circuit, when operative, controls transfer of information between the available oscillator and keyboard memories in a manner such that when a key select signal is terminated, the oscillator assigned thereto will continue operating and will be assigned in response to a subsequently initiated key select signal.

Additional important features relate to the envelope synthesizer circuit and to the manner in which it cooperates with the keyboard and control circuit. In response to initiation of a key select signal, an attack signal is applied from the keyboard and control circuit to the envelope synthesizer circuit and in response to termination of a key select signal and after a certain delay, a null signal is applied from the envelope synthesizer circuit back to the memory interchange control. In portamento operations, however, the null signal is not so applied.

Further very important features of the invention relate to the waveform synthesizer circuit. Means are provided for establishing a plurality of voltage levels representing the amplitudes at a plurality of points spaced in time in a waveform to be reproduced and analog multiplexer means are controlled from the voltage levels so established, and from the frequency signals to control development of the output signals. The frequency signals may preferably be developed at frequencies equal to a predetermined multiple of the fundamental frequency component of the tone to be reproduced, corresponding to the number of voltage levels established. For example, the frequency signals may be developed at frequencies three octaves above or eight times the frequency of the fundamental frequency component of the tone to be reproduced, and there may be sixteen voltage levels established, correspondong to each of the transition points of the controlling frequency signal. The frequency signal may be produced by aforementioned voltage-controlled oscillators or optional means such as digital counters clocked at a single high frequency in varying counting cycle lengths.

In accordance with an important specific feature, the voltage levels are established by means of a plurality of potentiometers which are manually set, the potentiometers being preferably operated by manually movable elements which are supported for movement in linear paths in parallel relation, so that a visual indication of the waveform to be produced can be obtained. With this arrangement, the musician using the instrument can adjust it to obtain a desired tonal quality and can learn how to quickly change from one tone quality to another during operation of the instrument. The instrument is thus quite simple with a minimum number of controls and, at the same time, it is simple in construction and design, requiring a minimum number of components and wiring which is comparatively simple.

The waveform synthesizer circuit includes a voltage controlled amplifier to which a gain control signal is applied, derived through an analog multiplexer from an analog demultiplexer in the envelope synthesizer circuit. The analog demultiplexer circuit of the envelope synthesizer is operated in synchronism with the analog demultiplexer of the keyboard and control circuit, while the analog multiplexer which operates to develop the gain control signal is operated in synchronism with the multiplexer and demultiplexer circuits of the waveform synthesizer circuit. The latter, preferably, may be operated at a much higher frequency than the demultiplexers of the keyboard and envelope synthesizer circuits.

Additional important features of the invention relate to the envelope synthesizer circuit which generates an analog signal corresponding to each of the frequency signals generated by the keyboard and control circuit, each envelope signal having an attack portion wherein the level rises to a predetermined level, a decay portion wherein it drops down to another predetermined level constituting a sustain level and a release portion generated in response to a release signal applied from the keyboard and control circuit, the envelope synthesizer being operative to develop a null signal at the end of the release portion. Manual controls may be provided for ready control of each of the portions of the envelope signal so generated.

The advantages of the invention are many and include the attainment of polyphonic portamento, the infinity duration release capability obtained in portamento operation and a waveform control which permits more accurate simulation of the tonal qualities of existing instruments and more flexibility, especially in generating new tonal qualities. The instrument uses a reduced number of standard available integrated circuits and is relatively inexpensive while having a relatively simple design and while being easier to troubleshoot.

The basic modular voltage-controlled structure of this polyphonic instrument is similar to that of common monophonic synthesizers thereby allowing maximum flexibility.

This invention contemplates other objects, advantages and features which will become more fully apparent from the following detailed description taken in conjunction with the accompanying drawings.

BRIEF DESCRIPTION OF THE DRAWINGS

FIGS. 5 and 5*a* are schematic block diagrams of an overload, re-attack and portamento control circuit of the keyboard and control circuit of FIG. 2;

FIG. 6*a* is a schematic diagram of an all-digital variation of a waveform synthesizer circuit 38 of the circuit of FIG. 1;

DESCRIPTION OF A PREFERRED EMBODIMENT

Figure 1:
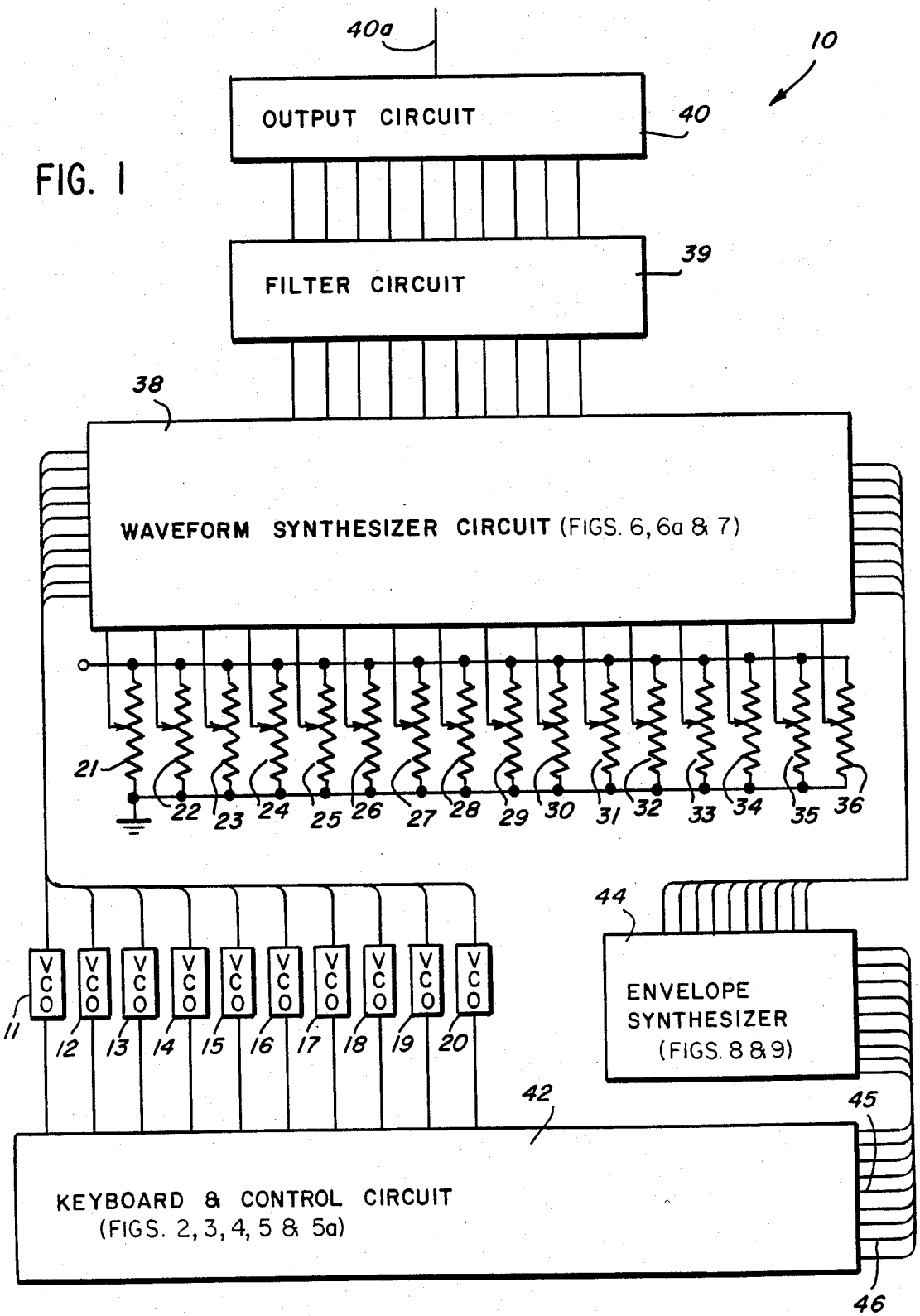
FIG. 1 is a schematic diagram showing the basic components of an electronic musical instrument construction in accordance with the invention.

Referring to FIG. 1, reference numeral 10 generally designates an electronic musical instrument constructed in accordance with the principles of this invention and including ten voltage controlled oscillators 11–20 for generation of output electrical signals from which up to ten tones can be produced simultaneously, it being understood that a lesser or greater number of such oscillators may be provided as desired.

Very important features of the invention relate to waveform synthesis; i.e., the control of the generation of signals having desired waveforms to obtain the desired tonal quality of sounds produced. In the system 10, the output electrical signals are generated in a manner such that the waveforms are readily controlled to produce the desired tonal quality. In a preferred mode of operation, the waveform of output signals is controlled from sixteen manually operable potentiometers 21–36 which are connected to a waveform synthesizer circuit 38 which has outputs connected through filters in a filter circuit 39 to an output circuit 40, line 40*a*. The output of said circuit being in another mode of operation, obtained through operation of a selector switch 41 (FIGS. 6 and 6*a*), the waveform may be controlled from a waveform memory circuit in the circuit 38, which may be a pre-set read-only memory or a random access memory to which information may be applied in any of a number of ways including dynamic waveform sampling.

The generation of the waveforms from the voltage controlled oscillators 11–20 is described in detail hereinafter. In brief, the voltage controlled oscillators 11–20 generate square wave signals are operated at frequencies three octaves above the fundamental frequency of the output signal to be reproduced there being sixteen transitions in the output of each oscillator during each cycle of the output signal to be reproduced. The outputs of the oscillators 11–20 are applied through multiplexer circuitry which is so controlled that in response to each output signal from one of the voltage controlled oscillators 11–20, a waveform is generated having in each cycle a plurality of sequential portions of equal duration (sixteen sequential portions in the illustrated system), with each having a predetermined amplitude. The amplitudes of the sixteen portions are controlled either by the settings of the potentiometers 21–36 or by the information in the waveform memory in the waveform synthesis circuit 38. A "stepped" waveform is thus produced at each output of the waveform synthesis circuit 38 in response to each applied signal from a voltage controlled oscillator, and is applied through a low pass filter in the filter circuit 39 to the output circuit 39, the low pass filter being operative to smooth out the steps of the waveform.

Additional important features of the invention relate to the control of the voltage controlled oscillators 11–20 from demultiplexer circuitry in keyboard and control circuitry 42. The keyboard and control circuitry 42 may include manually operable switches controlled from keys of a standard keyboard or may be in the form of automatically operated switches. The number of switches in either case may be much greater than the number of voltage controlled oscillators which is so selected as to permit generation of no more than the maximum number of tones required to be produced simultaneously in normal operation of the instrument.

Further important features of the invention relate to transient or envelope control circuitry for the control of the form of the envelope of each signal produced. Control inputs of the waveform synthesis circuit 38 are outputs of an envelope synthesizer 44 which is controlled from the keyboard circuit through lines including a line 45 on which a triggering signal is applied to initiate an initial attack portion of a waveform. The envelope synthesizer 44 is controllable by manually adjustable elements to control the form or rate and duration of the initial "attack" portion of a tone, the form of a following "decay" portion of a tone, the level of a "sustain" portion of the tone and the form of a final "release" portion of a tone. At the end of the tone, a null signal is applied back to the keyboard and control circuit 42. The output signals of this circuit or duplicate circuits may also be applied to other voltage controlled functions in the system such as filters.

There are thus three basic areas in which important features of the invention reside which are the keyboard circuitry for controlling the voltage controlled oscillators 11–20 from keyboard switches in the circuit 42, the waveform synthesizer circuit 38 for controlling the waveform of output signals generated from the voltage controlled oscillators 11–20 and the envelope synthesizer 44 for controlling the attack, decay, sustain and release portions of each tone generated. Such circuitry will be described in more detail, it being noted that additional features relate to the manner in which the circuits are combined to produce simultaneously a plurality of output signals each having the desired tonal quality, while using relatively uncomplicated circuit arrangements and while reducing the number of required controls and otherwise simplifying the control of the instrument, as well as making it easier and more economical to manufacture. It is understood that the functions of this system also may be implemented by a computer unit.

Keyboard and Control Circuitry

Figure 2:
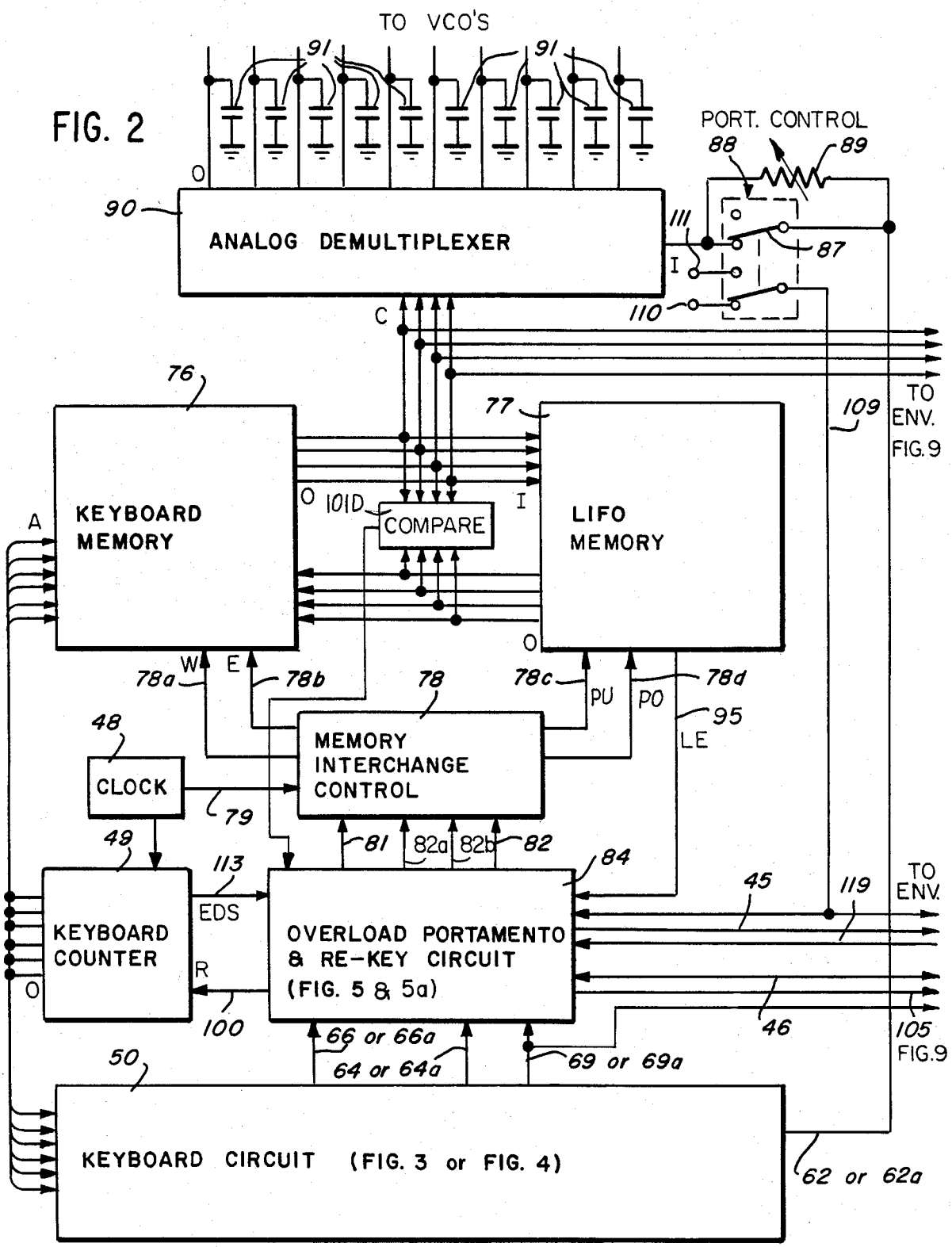
FIG. 2 is a schematic block diagram of a keyboard and control circuit 42 of FIG. 1.
Figure 3:
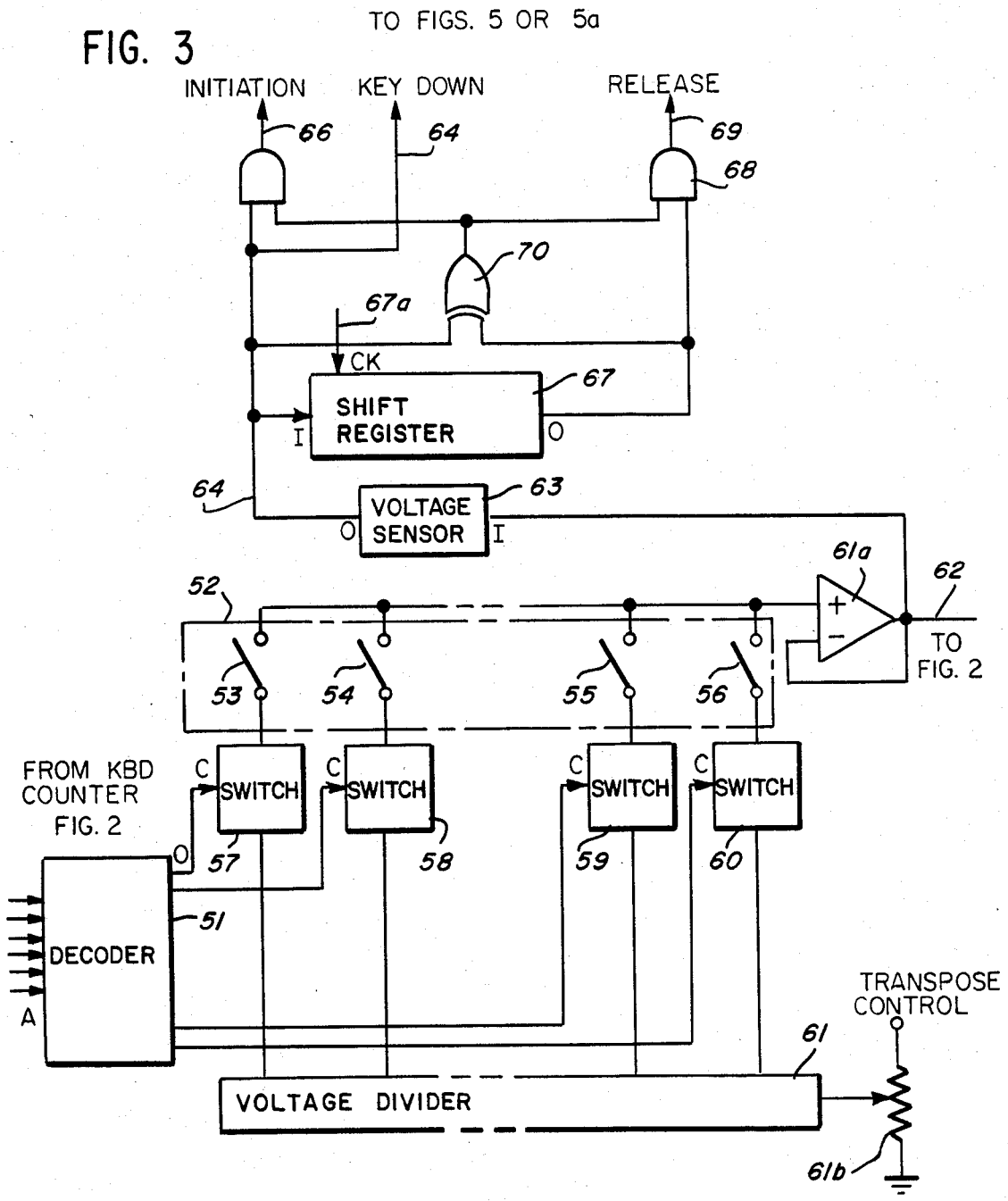
FIG. 3 is a schematic block diagram of one form of keyboard circuit 50 usable in the keyboard and control circuit of FIG. 2.

As shown in FIG. 2, a clock 48 is connected to a counter 49 having output lines which are connected to a keyboard circuit 50, such output lines being connected to a decoder 51 within the keyboard circuit 50 as shown in FIG. 3. The decoder 51 has output lines which respectively correspond to switches of a keyboard 52 and while only four key switches 53–56 are shown in FIG. 3, it will be understood that a large number may be provided from 30 switches to 100 or more switches, as desired. The illustrated key switches 53–56 are connected in series with switch circuits 57–60 between output terminals of voltage divider circuitry 61 and a line which is preferably connected to the output line 62 through a voltage follower **61*a* which provides a high impedance input and a low impedance output. The circuitry 61 may include suitable potentiometers connected between ground and a voltage input line and operate to develop voltages having magnitudes corresponding to the frequencies of tones to be reproduced. The voltage input line may be connected to the movable contact of a potentiometer 61*b* which is connected between ground and a voltage supply terminal, potentiometer 61*b* being operative to provide an adjustable voltage reference and as a transposition control. Output lines of the decoder 51 are connected to the switch circuits 57–60 and during a cycling time interval determined by the frequency of the clock 48 and the capacity of the counter 49, the switch circuits 57–60 are rendered operative in a certain order and a number of output pulses are developed on the output line 62 corresponding to the number of key switches which are closed. Each output has an amplitude corresponding to the voltage applied from the corresponding potentiometer within divider 61**, and each output pulse is developed in a time slot indicating the particular key switch which is closed. Thus an analog multiplexer operation is obtained.

The output line 62 is connected to a voltage sensing circuit 63 operative to develop a pulse on an output line 64 in response to each pulse developed on the line 62. The output pulses developed on the line 64 are applied through a gate circuit 65 to an output line 66 and also to a shift register 67 having an output connected through a gate 68 to an output line 69. The line 64 and the output of shift register 67 are also connected through a gate 70 to second inputs of gates 65 and 68. A clock signal is applied to shift register 67 through line **67*a***.

Figure 4:
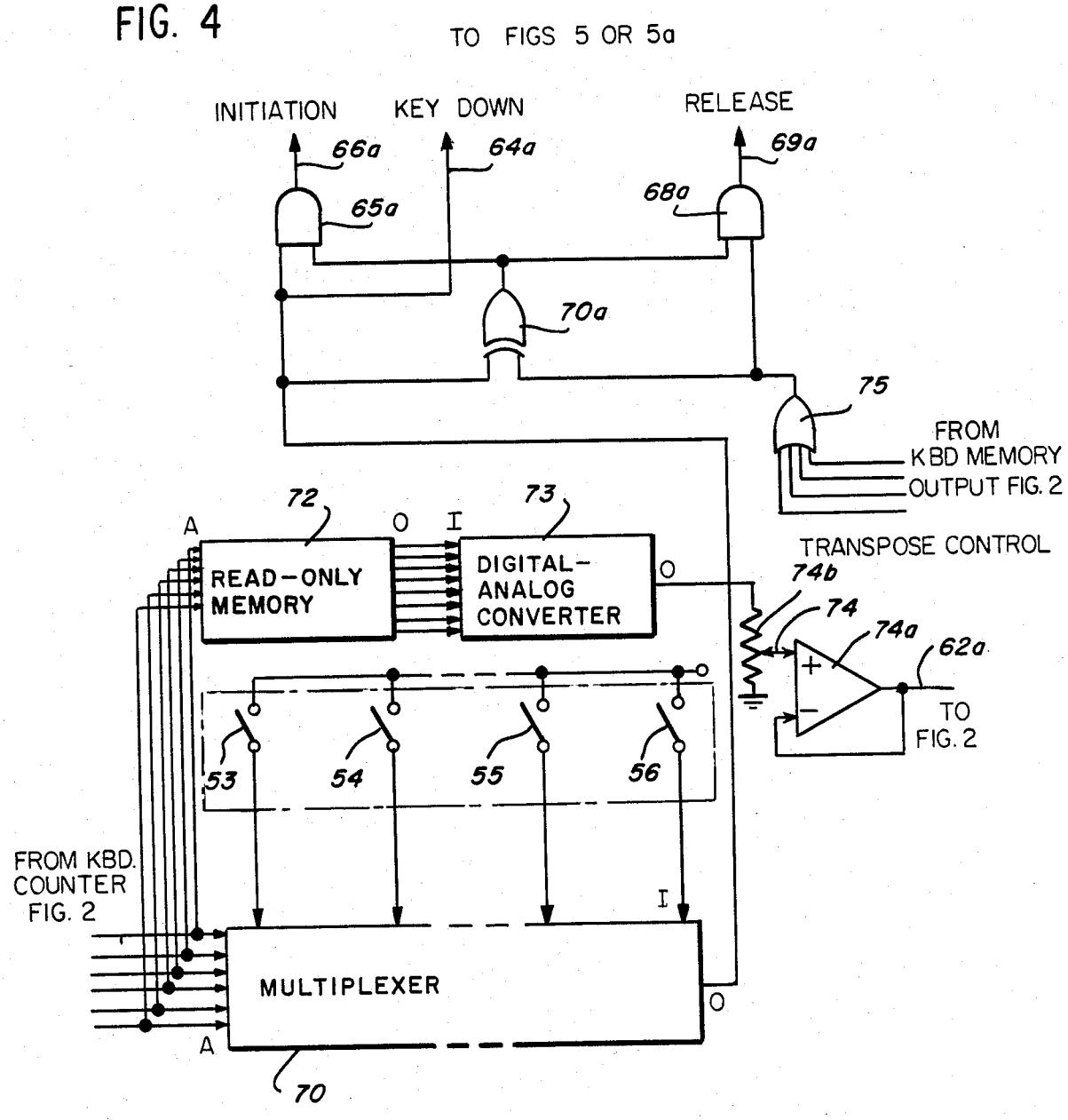
FIG. 4 is a schematic diagram of an alternate form of keyboard circuit 84 usable in the keyboard and control circuit of FIG. 2.

FIG. 4 illustrates a modified keyboard circuit in which key switches are connected to the input of a multiplexer 71 having inputs connected to the control lines from the counter 49, the output of the multiplexer 71 being connected to the inputs of gates **65*a* and 70*a* which correspond to gates 65 and 70 of FIG. 3. A read-only memory 72 is provided, also connected to the output lines from the counter 49, and having output lines connected to a digital-to-analog converter 73 to develop an analog signal on a line 74** which is connected to an output line 62*a* and which may be connected directly to the output of the converter 73 or as illustrated may be connected to the movable contact of a transposition potentiometer 74*b* connected to the output of the converter 73. An analog signal is developed on line 62*a* which has an amplitude corresponding to the frequency to be produced in response to actuation of the respective key switches. An input of gates 68*a* and an input of gate 70*a* are connected through a gate 75 to the output of a keyboard memory circuit (FIG. 2). The function and operation of gates 65, 68 and 70 of FIG. 3 and of gates 65*a*, 68*a* and 70*a* of FIG. 4 are described hereinafter.

Referring again to FIG. 2, the keyboard memory circuit 76 is connected to control lines from the counter 49 and is also connected to a last-in-first-out stack memory circuit 77 which is connected back to the keyboard circuit 76 through a group of four lines. A memory interchange circuit 78 is provided having output lines 78*a* and 78*b* connected to the keyboard memory 76 to apply "enter" and "erase" signals thereto and also having output lines 78*c* and 78*d* coupled to the memory 77 to apply "push" and "pop" signals thereto. A clock signal is applied to interchange circuit 78 through a line 79. The memory interchange control circuit 78 controls the transfer of channel address code from the LIFO stack memory 77 to the keyboard memory 76. The reverse process is also affected, transferring channel address code back from the keyboard memory 76.

Inputs of the memory interchange control circuit 78 are connected through lines 81 and 82 to outputs of an overload, re-key and portamento control circuits 84 which has inputs connected to output lines 66 and 69 of the keyboard circuit of FIG. 3 or output lines 66*a* and 69*a* of the keyboard circuit of FIG. 4.

An analog signal developed on the output line 62 or 62*a* of whichever the FIG. 3 or 4 keyboard circuits is used, is applied either through a contact 87 of a portamento on-off switch 88 or through an adjustable resistor 89 to an analog signal input of an analog demultiplexer 90 which has output lines connected to the voltage controlled oscillators 11–20. Contact 87 is closed in normal operation and is opened for portamento operation. Alternately, a suitable circuit comprising switched current sources may be used for the addition or subtraction of charge to the capacitors 91.

The last-in-first-out stack memory 77 contains information constituting the addresses of each of the voltage controlled oscillators 11–20 which is available for use at any one time, all of the voltage control oscillator addresses being in the memory 77 when none of the voltage controlled oscillators is in use. When a key switch is operated, a control signal is developed on line 64 of the FIG. 3 circuit or at the output of multiplexer 71 of the FIG. 4 circuit and is applied through the gate 65 or gate 65*a* and through line 66 and through gates in an overload, re-key and portamento circuit 84 and line 81 to the memory interchange circuit 78 to transfer the voltage controlled oscillator address out of the memory 77 and into the keyboard memory 76 in a time slot corresponding to the actuated key switch. At the corresponding time slot in the next cycle of operation of the counter 49 and in subsequent time slots, so long as the key switch remains closed, the keyboard memory 76 applies signals to the analog demultiplexer 90 to cause the analog signal from the output of the keyboard circuit to be applied to the input of the voltage controlled oscillator which has its address stored temporarily in the keyboard memory 76. When the key switch is opened, a null signal is thereafter applied from the envelope synthesizer 44 (FIG. 1) through line 46, and through gates in the overload and portamento circuit 84 and through line 82 to the control circuit 78 and a reverse operation takes place, the voltage controlled oscillator address stored in the keyboard memory being then transferred back to the memory 77.

Ten capacitors 91 are connected between ground and the inputs of the voltage controlled oscillators 11–20 for the purpose of maintaining the voltage levels thereat from one cycle to another and for cooperation with resistor 89 in portamento operation as hereinafter described.

Figures 2, 5:
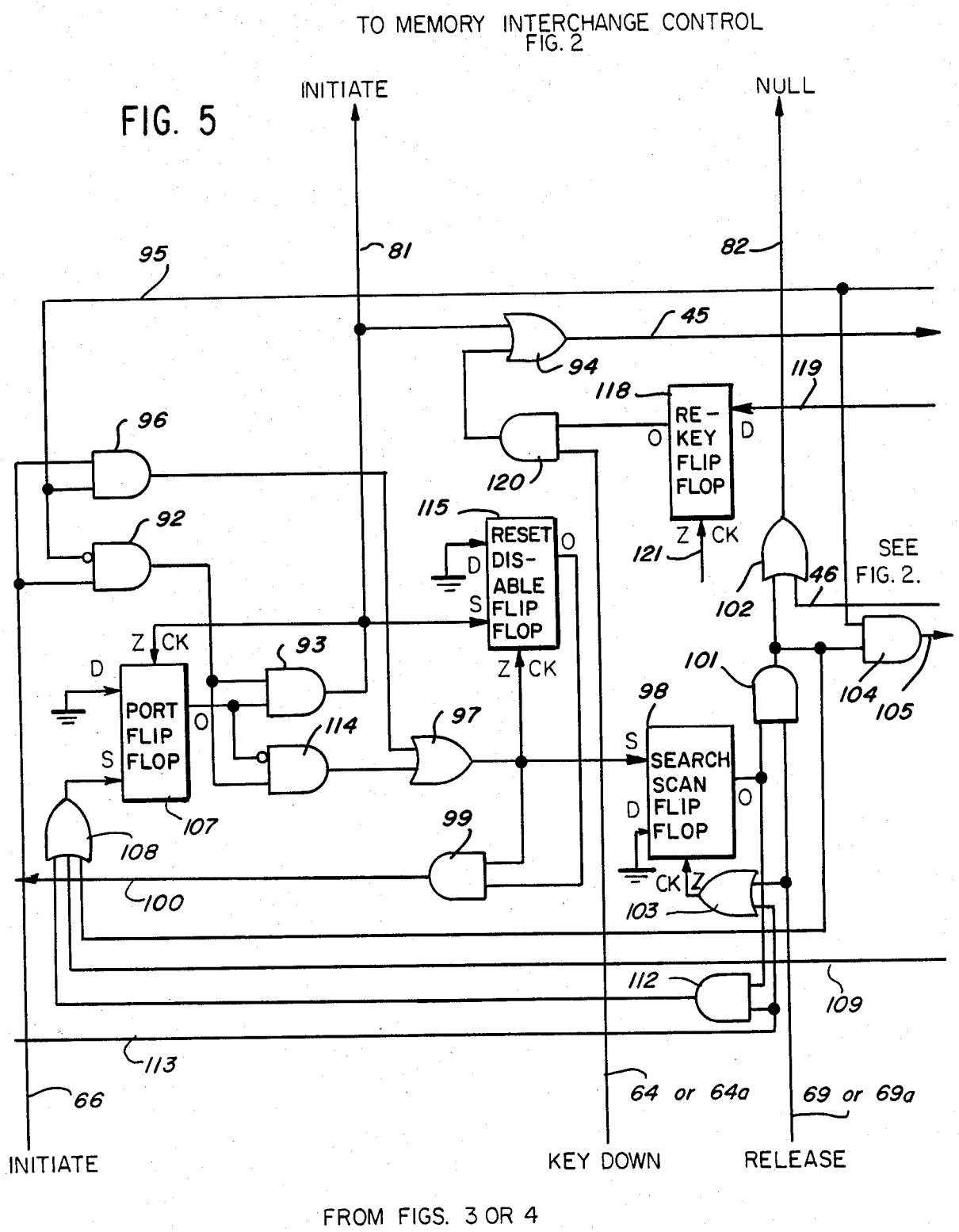
Figure 5A:
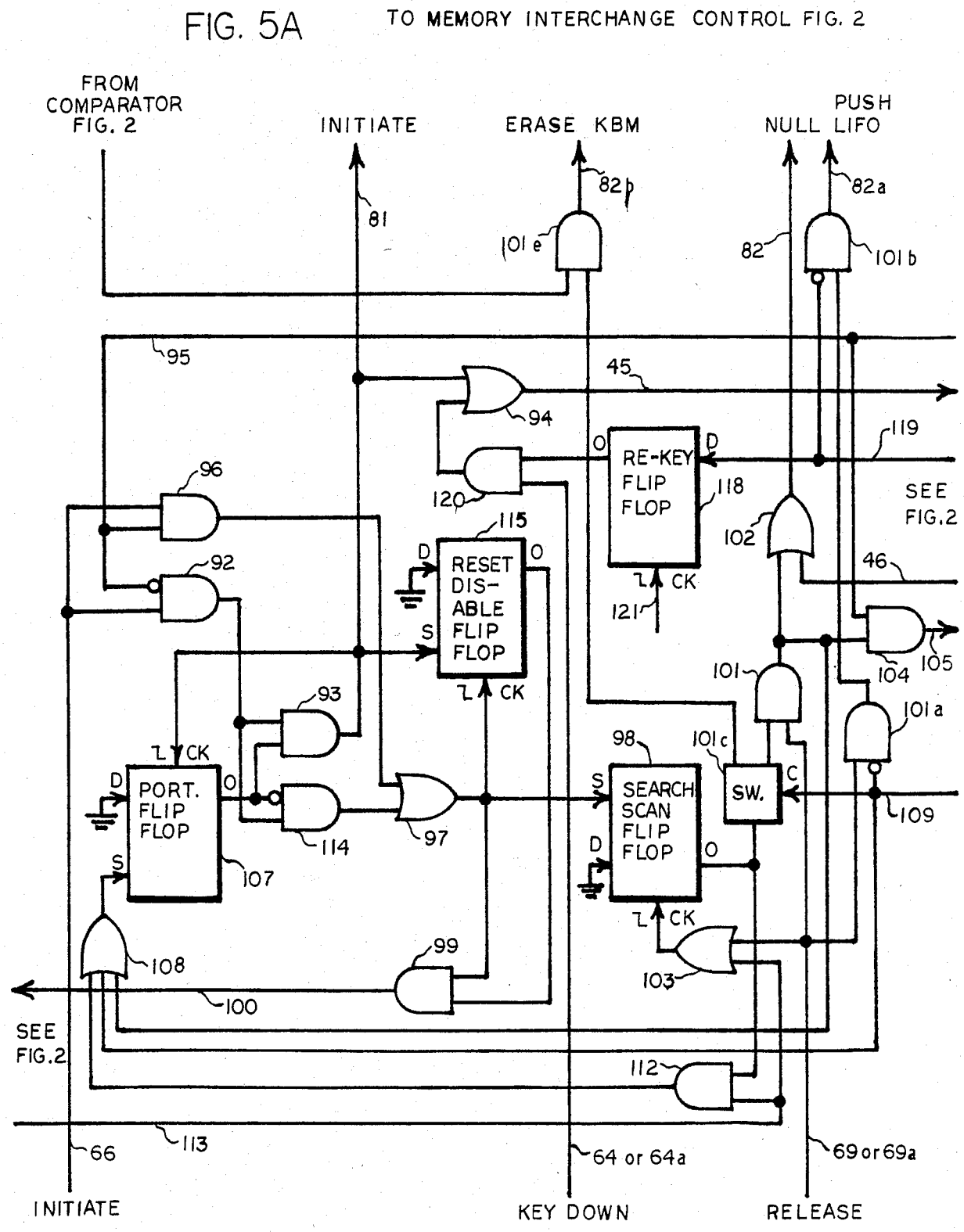
FIG. 5*a* is a schematic diagram of a variation of the control circuit 84 of FIG. 2 which allows release-ordered portamento channel assignment.

Two example embodiments of the overload, re-key and portamento control circuit 84 are shown in FIGS. 5 and 5*a*. The only difference between the functions of the two embodiments is that the circuit of FIG. 5 controls the channel assignment function of release position-ordered portamento. It is understood that the basic functions of the overload, portamento and re-key circuit 84 may be implemented by a computer unit or by different arrangements of gates, flip-flops and other circuit components. The overload re-key and portamento control circuit 84 shown in FIG. 5 includes a gate 92 and a gate 93 connected in series between the line 66 from the keyboard circuit 50 and line 81 which is connected to the memory interchange control circuit 78, line 81 being also connected through an OR gate 94 to the line 45 to apply an attack signal to the envelope synthesizer circuitry. In operation in which there is no overload and in which the portamento circuitry is inoperative, signals effectively pass directly from line 66 through the gates 92 and 93 to the line 81 and through gate 94 to the line 45. When there is an overload condition in which more voltage controlled oscillators are required than are available, the gate 92 may be closed and the gate 93 may be closed at times during portamento operations as hereinafter described.

With regard to the overload control, the gate 92 has an input connected through a line 95 to the last-in-first-out stack memory circuit 77 to close the gate 92 when the memory 77 is "empty"; i.e., when no voltage controlled oscillators are available. At the same time, a gate 96 which has one input connected to the line 95 is rendered operative to cause application of a signal from the line 66 through gate 96 and through an OR gate 97 to the set input of a flip-flop 98. A signal is also applied from the output of gate 97 and through an AND gate 99 to a reset line 100 for the keyboard counter 49, a scanning operation of the keyboard memory being then initiated. The flip-flop 93 has an output connected through an AND gate 101 to one input of an OR gate 102. The gate 102 has a second input connected to line 46 to receive a null signal from the envelope synthesizer and has an output connected to line 82 to apply a null signal to the memory interchange control.

A second input of AND gate 101 is connected to the line 69 and when during the scanning of the keyboard, initiated by the signal applied through gate 69, a release signal is developed on line 69, it is applied through gate 101 and gate 102 to line 82 to apply a null signal to the memory interchange control. Line 69 is connected to the clock input of flip-flop 98 through gate 103 and the trailing edge thereof rests the flip-flop 98.

Thus a scanning operation is performed in the overload condition and the first released key detected sends a null signal through line 69, gates 101 and 102 and lines 82 to exchange the voltage controlled oscillator address thereof from the keyboard memory 76 to the memory 77. Also, the first released key detected sends a null signal through line 69, gate 101, a gate 104, and a line 105 to a switch 106 in the envelope synthesizer (FIG. 9) for shorting a capacitor in the envelope to ground. Thereafter, an attack signal may be transmitted in normal fashion to in effect "seize" the voltage controlled oscillator which was released. Depending upon the direction of scan, the overload circuitry thus eliminates the highest or lowest note on the keyboard which is in the release state when more than ten oscillators are needed.

With regard to the portamento portion of the circuitry, the gate 93, which has one input connected to the output of the gate 92, has a second input connection to an output of a flip-flop 107 which has a set input connected to the output of an OR gate 108 having one input connected to a line 109. Line 109 is connected through the portamento switch 88 to a positive power supply terminal 110 or a negative power supply terminal 111. A second input of the OR gate 108 is connected to the output of an AND gate 112, an output of which is connected through a line 113 to the keyboard counter 49 to receive an end-of-scan signal therefrom and a third input is connected to the output of the gate 101. The other input of gate 112 is connected to the output of flip-flop 98. Line 113 is also connected to the input of gate 103 to reset the flip-flop 98. An inverted output of the flip-flop 107 is connected to an input of a gate 114 which has a second input connected to the output of the gate 92 and which has an output connected to a second input of the gate 97.

The output of the gate 93, which is connected to line 81, is also connected to a clock input of flip-flop 107 and in addition to a set input of a flip-flop 115 having an output connected to one input of gate 99 and having a clock input connected to the output of gate 97.

Figure 9:
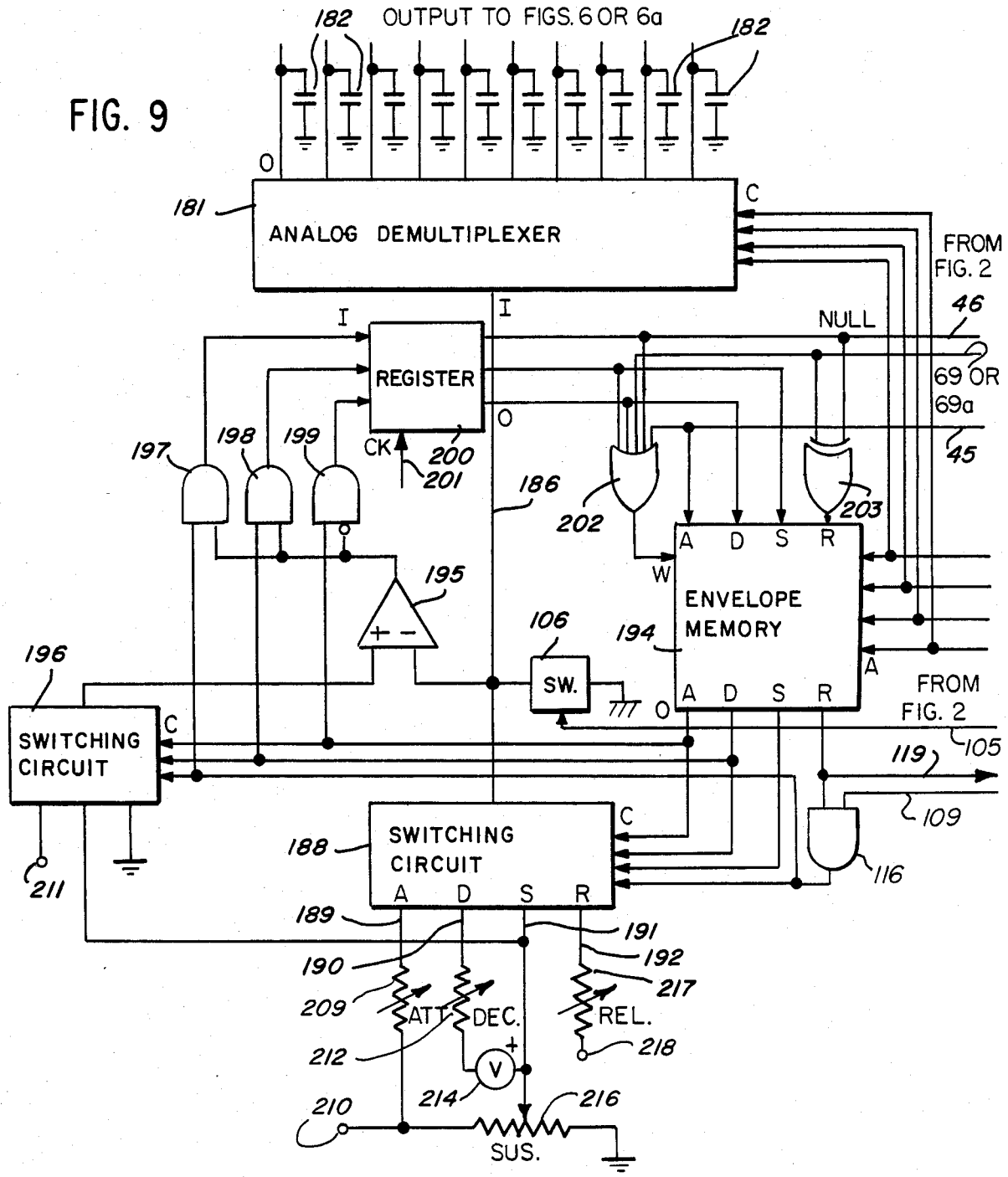
FIG. 9 is a schematic diagram of the envelope synthesizer circuit 44 of the instrument of FIG. 1.

Referring to FIG. 9, an AND gate circuit 116 is provided having its output connected to control a switching circuit 188, a switching circuit 196, and a gate 197 and having one input connected to the release output of the envelope memory 194 and a second input connected to line 109 which is connected to terminal 110 or terminal 111 (FIG. 2). In normal operation, line 109 is connected to terminal 110 and is at a high level, gate 116 is open and the release signal is transmitted.

In portamento operation, however, line 109 is at a low level and gate 116 is closed so that no release signal is transmitted to the switching circuits of the envelope synthesizer and as a result it is possible to hold one or more tones in a sustained condition indefinitely, if desired. Also, in portamento operation, the flip-flop 107 is set either by a signal applied through gate 108 and through line 113 from the "carry" output of the keyboard counter 49 or by a high level signal applied through gate 108 and line 109 from terminal 110 whether the operation of the instrument is initiated with the portamento switch in an "on" condition with line 109 at low level or if the portamento switch is operated to an "on" condition during operation of the instrument. The flip-flop 107 in either case is initially in a set condition and is not reset until the trailing edge of the first attack signal applied to its clock input from the output of gate 93. Thus during portamento operation at least one voltage controlled oscillator will be operative in generating a tone.

In response to each attack signal thereafter applied, gate 93 is initially closed and a signal is applied through gate 114, gates 97 and 99 and line 100 to reset the keyboard counter 49 and to initiate a scanning operation and a signal is also applied to the set input of flip-flop 98 to operate it to a set condition. If during the scanning operation, a release signal is developed on line 69 or line 69*a*, it is applied through gate 101 and through gate 108 to set the flip-flop 107 and is also applied through gate 101 and through gate 102 and line 82 to apply a "null" signal to the memory interchange control and to exchange the voltage controlled oscillator address of the released key from the keyboard memory 76 to the memory 77.

The attack signal may then be transmitted in normal fashion through gates 92 and 93 to in effect seize the voltage controlled oscillator which was released. If no release signal is detected in the scanning operation, the flip-flop 107 is set by a carry signal applied through line 113 and gate 108 and the next attack signal is applied in normal fashion to seize an additional voltage controlled oscillator. Thus, the function of release position-ordered portamento is obtained. That is, the oscillator of the highest (or lowest) released key on the keyboard is assigned to the newly actuated key. This function is to be distinguished from an alternate function which is hereinafter described.

Flip-flop 115 operates to control gate 99 to prevent the attack signal from repetitively resetting the keyboard counter.

Accordingly, as keys are operated during portamento operation to develop attack signals, voltage controlled oscillators are seized to develop corresponding signals and signals are applied to the envelope synthesizer to develop tones which are sustained indefinitely, gate 116 (FIG. 9) being closed. When a key is released, the corresponding oscillator remains operative and is seized by the next attack signal applied, regardless of the length of time to the next attack signal. If the next attack signal is from a different key, the frequency of the voltage controlled oscillator is changed at a rate that may be determined by the values of the resistor 89 and capacitor 91. Alternately, the function of release sequence-ordered portamento is also obtainable. This function uses the LIFO stack memory to advantage.

Referring to FIG. 5*a*, When a release signal first appears on line 69 or 69*a* for any key the channel address in the keyboard memory 76 is written into the LIFO memory 77 but not erased from the keyboard memory 76. This "channel address duplicate" command is transmitted by line 82*a*. Gate 101*a* acts to transmit the note release signal of line 69 or 69*a* if the portamento enable line 109 is active-low. Gate 101*b* further transmits the note release signal through line 82*a* if the envelope memory 194 does not yet contain release information as transmitted by line 119.

The switch 101*c* acts to transmit the enabling signal from the output of the search scan flip-flop 98 to either gate 101 or gate 101*e* depending on the state of the control line 109. If this portamento enable line 109 is inactive high gate 101 will receive the output signal of the search scan flip-flop 98 for the usual overload circuit function. If line 109 is active low then the gate 101*e* receives the output signal of the flip-flop 98.

When a note initiation signal appears at line 66 a search scan of the keyboard is made as previously described. However the search in the sequence-ordered mode is for the channel address which was last entered into the LIFO memory 77, or alternately first entered into the FIFO memory 77. During the search scan, when the digital word comparator 101*d* of FIG. 2 which is connected to gate 101*e* signals identical channel address information in both memories 76 and 77, gate 101*e* sends a signal through line 82*b* to erase the channel address from the keyboard memory 76. In the subsequent scan of the keyboard the note initiation signal is transmitted to the memory interchange control through line 81 as usual.

This process gives nested release-controlled portamento channel assignment and allows greater flexibility for the performer. For example, if the triad C-E-G is played and released in the order C-G-E the next three keys to be played will be assigned to the oscillators of the E,G, and C in that order.

The circuit 84 further includes a re-key control circuit including a flip-flop 118 connected to a line 119 to receive a release mode signal from the envelope synthesizer memory, and having an output connected to one input of an AND gate 120 having an output connected through gate 94 to the attack line 45 and having a second input connected to line 64 from the FIG. 3 circuit or line 64*a* from the alternative FIG. 4 circuit, a clock signal being applied to flip-flop 118 through line 121. When a key is depressed a second time, before a null signal is generated, the flip-flop 118 is set and an attack signal is applied through gate 120 and gate 94 to initiate another envelope but the attack signal is not again applied to the memory interchange and the same voltage controlled oscillator is used. This circuit also eliminates channel reassignment caused by key switch "contact bounce".

Waveform Synthesizer Circuitry

Figure 6:
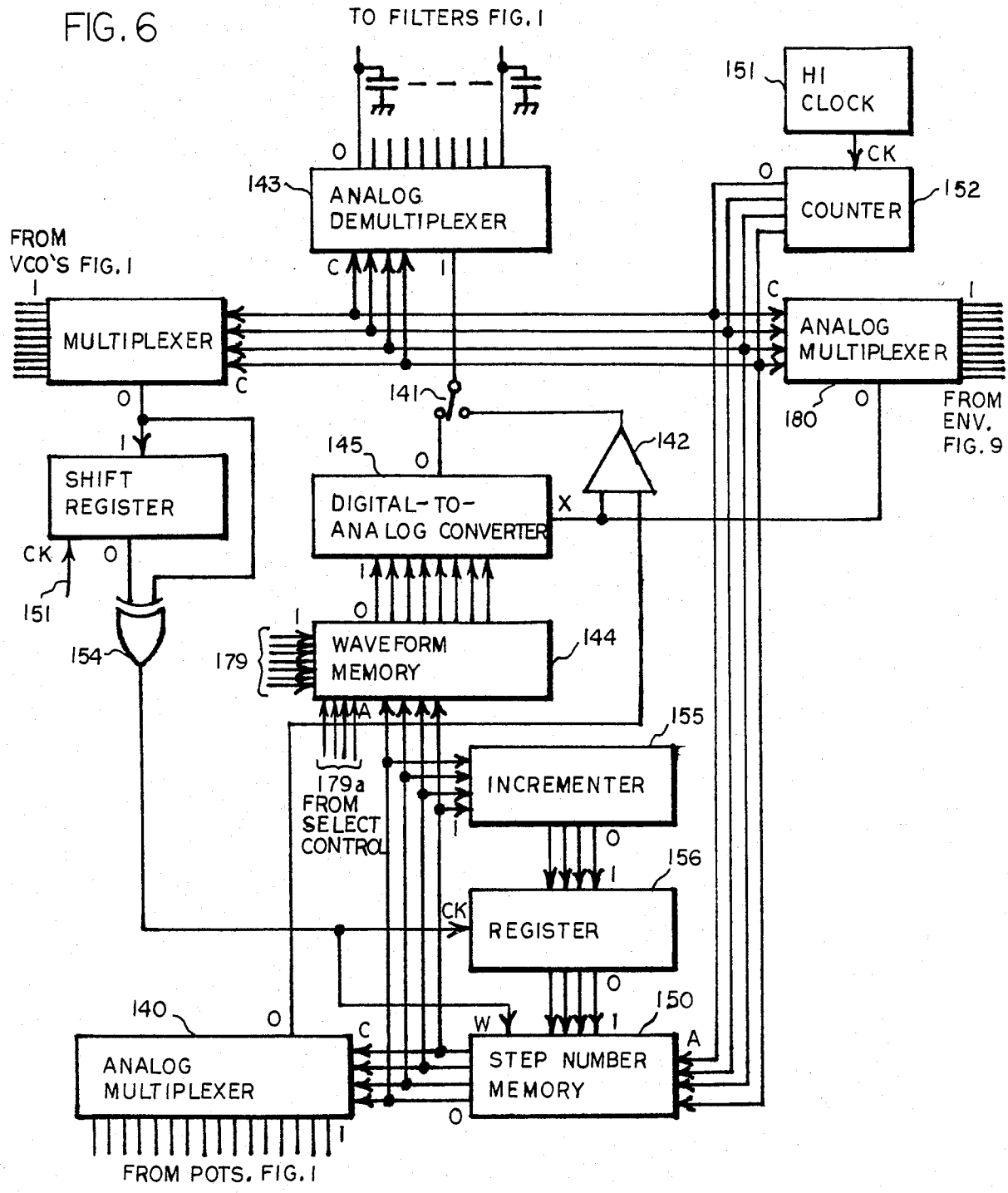
FIGS. 6 and 6*a* are schematic diagrams of a waveform synthesizer circuit 38 of the circuit of FIG. 1.

As shown in FIG. 6, the waveform synthesizer circuit 38 includes an analog multiplexer 140 having inputs connected to the movable contacts of the potentiometers 21–36 (FIG. 1) and having an output connected through a switch circuit 141 to an input of a voltage controlled amplifier 142 which has its output connected to an analog demultiplexer 143. A waveform memory circuit 144 is connected through a digital-to-analog converter 145 and a switch 146 to the input of amplifier 142 to which the output of switch 141 is connected. Switches 143 and 146 are controlled by the switch 41 for selective use of potentiometers 21–36 and waveform memory 144.

Obviously, different sources of channel frequency may be used for the channels including digital counters counting in cycles of varying lengths as well as voltage-controller oscillators. As indicated above, each of the voltage controlled oscillators is operated at a frequency three octaves above, i.e. eight times, the frequency of the fundamental component of the tone to be produced. In the waveform synthesizer circuitry, the output of all of the voltage controlled oscillators, which are square wave signals, are scanned by means of circuitry including a multiplexer 148 and a counter 152 to detect changes in state or transitions with there being sixteen transitions in each cycle of the fundamental of the tone to be reproduced. In response to each series of sixteen consecutive transitions of each voltage controlled oscillator output signal, a series of output pulses are developed by an analog multiplexer 140, or by digital-to-analog converter 145, corresponding to the setting of the potentiometers 21–36 or to the information in the waveform memory circuit 144.

To scan channel frequency signals for transitions, a clock 151 is provided which supplies a signal to a counter 152 connected to the multiplexer 148 to apply control signals thereto, the multiplexer 148 being connected to the outputs of the voltage controlled oscillators 11–20. Clock 151 is operated at a frequency which is substantially higher than the highest frequency produced by a voltage controlled oscillator and may be operated at a frequency of 1 MHz, for example. The output of the multiplexer 148 is supplied to a serial-in-serial-out shift register 153 which has a number of stages equal to the number of channels, i.e. ten stages in the illustrated system. At any given time, the output of the multiplexer 148 represents the state of one of the channel frequency signals and at the same time, the output of the shift register 153 represents the state of the output of the same voltage controlled oscillator in the preceding scan. The output of the shift register 153 and the output of the multiplexer 148 are compared by a gate circuit 154, the output of which is applied to the "write" input of the step number memory 150 and to the clock input of a register 156. In response to a difference in states at the inputs thereof, the output of the gate circuit 154 goes high thus applying a "write" signal to the step number memory 150 which stores status information as to the point in the cycle of development of each of the output signals being developed. The address input of the step number memory 150 is connected to the counter 152.

The memory 150 then controls the analog multiplexer 140 to cause it to develop a signal at its output corresponding to the voltage output from one of the potentiometers 21–26 and at a time slot controlled by the counter 152 and corresponding to the channel frequency signal which produced the transition signals. Such signals are also applied to the waveform memory 144 to cause development by the converter 145 of an analog signal porportional to the amplitude of a desired signal at one sample point. In addition, signals are applied through an incrementer circuit 155 to a register circuit 156 connected to the step number memory 150 to add a "one" thereto and to shift to a succeeding point in the cycle. When during a succeeding cycle another transition of the same channel frequency signal is detected, the analog multiplexer 140 develops an output signal corresponding to the analog signal at the next one of the potentiometers 21–36, with a similar operation being effected with respect to the waveform memory 144 and converter circuit 145. Thus waveforms are produced corresponding to sample points of desired waveforms.

As indicated above, the selector switch 41 is operable to connect either the output of the voltage controlled amplifier 142 or the output of the converter circuit 145. When the input of the voltage controlled amplifier 142 is connected to the output of the analog multiplexer 140, the waveform is controlled by the positions of the adjustable potentiometers 21–36.

Figure 7:
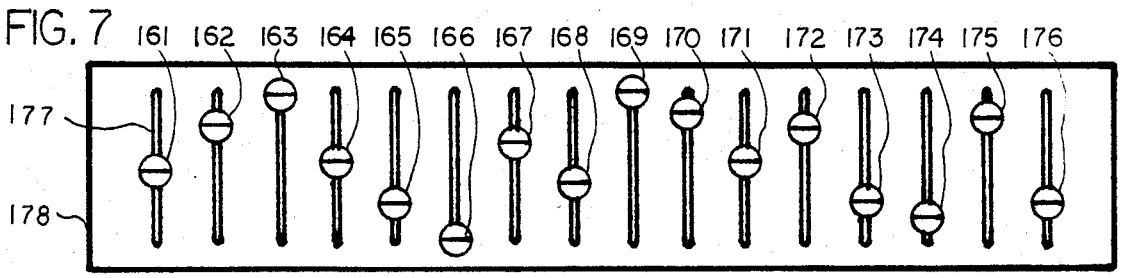
FIG. 7 is a view illustrating the arrangement of manual control elements for potentiometers of the circuit.

As illustrated in FIG. 7, operating knobs 161–176 are provided which project from parallel slots 177 in a panel 178 and are mechanically coupled to the movable contacts of the potentiometers 21–36 preferably with the potentiometers 21–36 being linear potentiometers and with there being a direct connection between the movable contacts and the control knobs 161–176. With this arrangement, the control knobs present a visual indication of the waveform produced and can be set, for example, in accordance with a waveform viewed on an oscilloscope. By experimentation, the user can determine how changes in tones can be produced by manipulation of the knobs. It is also possible to provide suitable forms for various instruments to be produced, as by providing an overlay sheet having indicia thereon indicating the contour of the tone to be reproduced and the positions of the knobs 161–176.

When the input of the analog demultiplexer 143 is connected to the output of the digital-to-analog converter 145, through switch 141 the waveform is controlled by the waveform memory 144 which may be a random access memory to which information signals may be supplied through a group of lines 179. Such information signals may, for example, correspond to information developed from the settings of the potentiometers 21–36 when a desired tone quality is produced from experimentation. It is possible to provide a dynamic tone control in which signals are developed by sampling an actual tone signal with the sample signals being applied to the memory 144. If desired, the memory 144 may be controlled through lines 179*a* by selector switches and may be a read-only memory which is preferably selectively operable for reproduction of tones corresponding to a number of musical instruments and/or to the stop tabs of an organ.

The waveform synthesizer circuitry as illustrated provides individual channel volume control which also includes an analog multiplexer 180 having control inputs connected to outputs of counter 152 to be operated in synchronism with demultiplexer 143, multiplexer 148 and step number memory 150. The output of analog multiplexer 180 is connected to the gain control input of the amplifier 142 and the multiplying input of the converter circuit 145 and inputs of the analog multiplexer 180 are connected to outputs of the envelope synthesizer 44.

Envelope Synthesizer

Figure 6A:
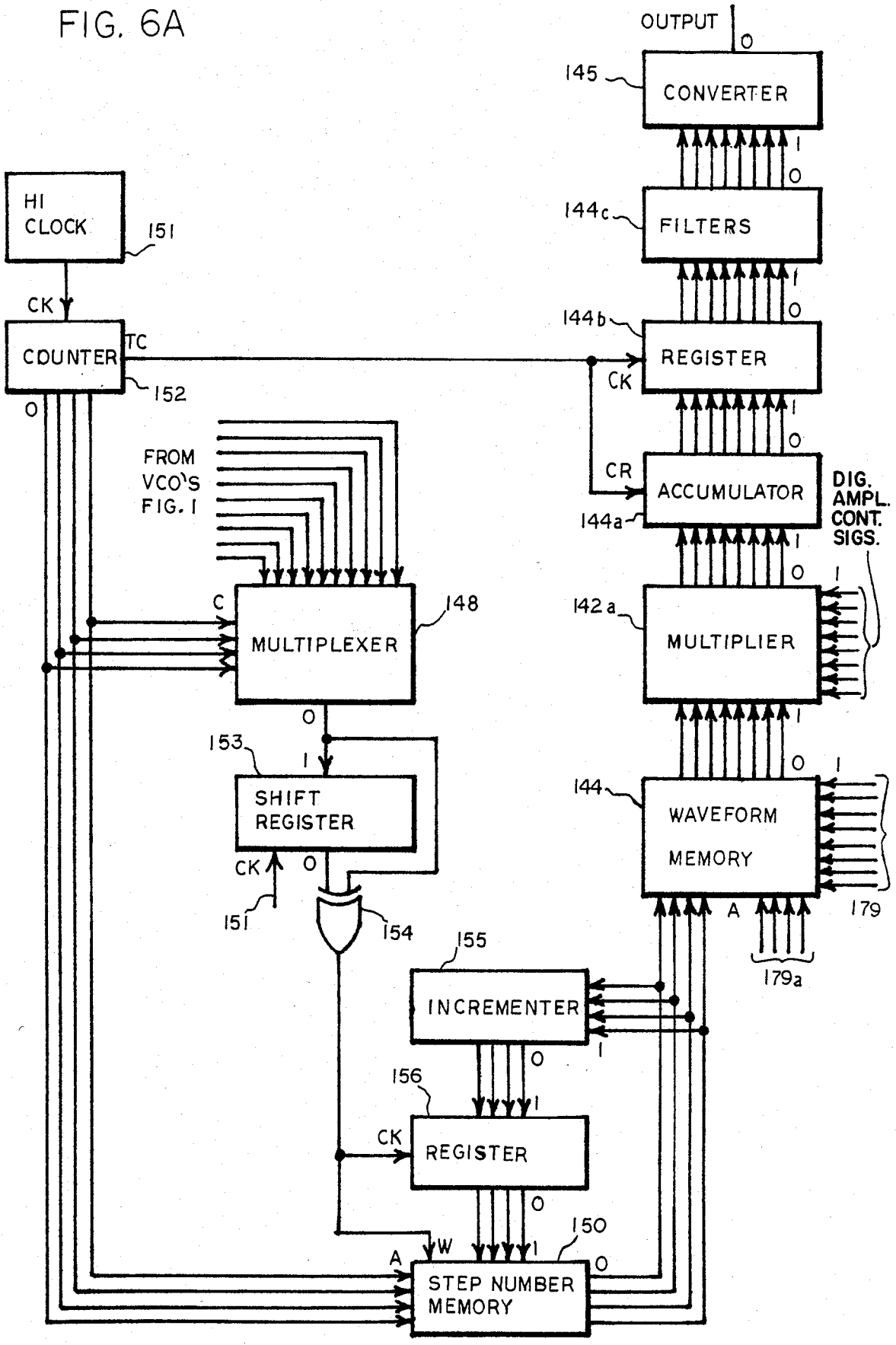

The alternate waveform synthesizer circuit 38 as shown in FIG. 6*a* has a single output in the form of a digital bus or converted to an analog signal. The accumulator 144*a* is controlled so as to add all amplitude values received from the waveform memory over the period of one scan of all the channels. The resulting sum is then transmitted by the register 144*b* as the output value during the subsequent scan. Immediately following each scan the contents of the accumulator are set equal to zero.

A high speed digital multiplier 142*a* may be used. The output bus is connected to the accumulator 144*a* with one input bus connected to the output of the waveform memory 144 and the other input bus receiving digital amplitude control signals multiplexed sequentially by channel and synchronized with the scanning counter 152. The output of the accumulator is clocked into a register 144*b* once after each scan.

The output signal from the register 144*b* may then be passed through digital filters 144*c* and a converter circuit 145.

Figure 8:
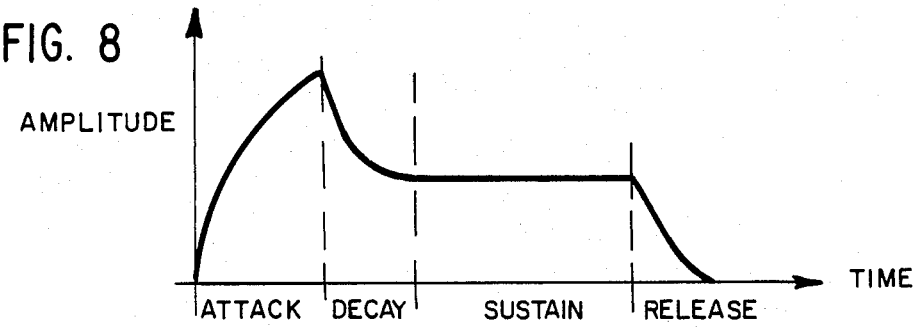
FIG. 8 is a diagram illustrating the form of an envelope signal developed by an envelope synthesizer circuit 44 of the instrument of FIG. 1.

The envelope synthesizer 44 (FIG. 1) operates to generate an envelope signal corresponding to each voltage controlled oscillator each such signal having a form as illustrated in FIG. 8. Each includes an "attack" phase which is initiated for example by depression of a key and which has an exponentially rising form, a "decay" phase wherein the amplitude falls exponentially, a "sustain" uniform amplitude portion and a final "release" portion initiated by release of a key, wherein the amplitude falls to zero. The release phase may also be omitted entirely. The signals so generated are applied to ten inputs of the analog multiplexer 180 in the circuit of FIG. 6 to control the amplitudes of generated tones. The signals could also be used to control other functions such as roll-off frequencies of voltage controlled filters. Therefore, in general, the envelope synthesizer 44 could also be called a transient synthesizer and a plurality of transient synthesizers could be used per instrument. The signals are developed at the outputs of an analog multiplexer 181 in the envelope synthesizer circuit shown in FIG. 9, such outputs being connected through ten capacitors 182 to ground. The analog demultiplexer 181 is connected to output lines of the keyboard memory 76 in a manner such that when the input of the analog multiplexer 90 is connected to one of the voltage controlled oscillators, an input line 186 of the analog demultiplexer 181 is at the same time connected to a corresponding one of the outputs thereof and one of the capacitors 182.

The input line 186 is connected through a switching circuit 188 to four lines 189–192 for control of four phases of an envelope for each tone generated, switching circuit 188 being controlled from an envelope memory circuit 194 which is connected to the output of the keyboard memory 76. Input line 186 is also connected to one input of a differential amplifier 195 which at any given instant of time compares the voltage level at one of the capacitors 182 with a reference voltage developed from a switch circuit 196 connected to the memory 194. The output of the amplifier 195 is connected through gate circuits 197, 198 and 199 to a register 200 which has two outputs connected to inputs of the memory 194, an additional output connected to the line 46 and an input connected to line 201 to a clock signal source. Gates 202 and 203 are provided having outputs connected to read-write and data inputs of the envelope memory 194. Two inputs of gate 202 are connected to the decay and sustain outputs of the register 200. The "null" line 46 from the "null" output of the register 200 is connected to one input of both gate 202 and 203. Another input of gate 202 is connected to the attack line 45 which is also connected to an input of the memory 194. Still another input of gate 202 and a second input of gate 203 are both connected to release line 69 or 69*a*.

In operation, when a key switch is closed, a signal is applied from the "attack" line 45 to one input of the envelope memory 194 and also through gate 202 to the write-read input of the envelope memory 194. As above described in connection with the keyboard circuitry, when a key switch is closed, one of the voltage controlled oscillators 11–30 is assigned thereto and signals are stored in the envelope memory 194 as to the envelope status of the voltage controlled oscillator so assigned, indicating that the assigned voltage controlled oscillator is in an "attack" stage. During subsequent cycles of operation of the counter 49, and in a time slot corresponding to the same assigned voltage controlled oscillator, the input line 186 of the analog demultiplexer 181 is connected to the corresponding one of the capacitors 182 and is also connected through switching circuit 188 to the line 189 which is connected through an adjustable resistor 209 to a power supply terminal 210. The capacitor 182 to which line 186 is connected is then charged through the resistor 209 toward the potential of the terminal 210. At the same time, the voltage developed on the line 186 and across the capacitor connected thereto is applied to one input of the amplifier 195 and thereby compared with a reference potential applied from a terminal 211 and through the switching circuit 196 to a second input of amplifier 195. When in a subsequent cycle of operation, the voltage level across the capacitor 182 reaches the reference level of the terminal 211 preferably just below terminal 210, a signal is applied to the register 200 through the gate 199 and signals are stored in the memory circuit 194 to indicate the end of the "attack" portion of the envelope for the voltage controlled oscillator being controlled and at the same time, signals are applied from the envelope memory 194 to the switching circuit 188.

As a result, the line 186 in subsequent cycles is connected through an adjustable resistor 212 and through a battery or other voltage or bias source 214 to a line 191 which is connected to the movable contact of a potentiometer 216 connected between ground and the voltage supply terminal 210. The capacitor in such subsequent cycles in "decay mode" operation is then discharged through the resistor 212 toward the potential established by potentiometer 216 and source 214 and when it reaches a level nearly equal to the potential of line 191, the amplifier 195 is again operative to initiate another mode through gate 198 in which the line 186 is connected directly to line 191. During such operation, a constant "sustain" level is maintained.

When a key is released, a signal is applied through line 69 or 69*a* and gates 202 and 203 to the memory 194 and in subsequent cycles, the switch circuit 188 is controlled from the memory 194 and gate 116 to connect line 186 to line 192 which is connected through an adjustable resistor 217 to a terminal 218 which may preferably be at a potential slightly below ground potential. The corresponding one of the capacitors is then discharged at a rate determined by its value and the value of the adjustable resistor 217. Also, the switch circuit 196 is so controlled from the memory 194 as to allow a reference potential equal to ground potential to be applied through a resistor 170 to an input of the differential amplifier 195. When the capacitor is discharged to ground potential, a signal is applied from the output of amplifier 195 and the gate 197 to the register 200 which then applies a null signal to the envelope memory 194 through line 46, and gates 202 and 203.

I claim as my invention:

1. An electronic musical instrument comprising wave synthesis means for the production of a plurality of stepwise complex waveforms associated with a corresponding plurality of channel means associated with a corresponding plurality of frequency signals each having a rate of repetition proportional to the fundamental frequency of the corresponding said stepwise complex waveform wherein said waveform synthesis means comprises:

means for scanning said plurality of frequency signals, means for detecting changes in state of said plurality of frequency signals from one said scan to the next, memory means containing a plurality of step number code words associated with the corresponding said plurality of channel means, and incrementer means connected in a feedback loop with said memory means.

2. An electronic musical instrument as defined in claim 1 further comprising waveform memory means containing amplitude information.

3. An electronic musical instrument as defined in claim 2 wherein said amplitude information is in the form of digital code.

4. An electronic musical instrument as defined in claim 3 wherein said amplitude information continuously varies.

5. An electronic musical instrument as defined in claim 2 wherein said amplitude information is in the form of analog voltage stored in a plurality of linear motion potentiometers arranged in parallel with said potentiometers being connected to analog multiplexer means.

6. An electronic musical instrument as defined in claim 1 further comprising analog output demultiplexer means receiving a multiplexer analog signal from digital-to-analog converter means where said converter means receives the digital output signals from the output of said waveform memory means.

7. An electronic musical instrument as defined in claim 3 further comprising:

accumulator means receiving said amplitude information and controlled in such a manner as to set the information contained in said accumulator means equal to zero following each said scan of said plurality of frequency signal, and register means receiving said accumulator information at the end of each said scan of the channels.

8. An electronic musical instrument as defined in claim 6 further comprising;

analog multiplexer means synchronized to said scanning means with inputs connected to a plurality of analog modulating signals corresponding to said plurality of channel means, and multiplier means responsive to output of said analog multiplexer means.

9. An electronic musical instrument as defined in claim 3 further comprising digital multiplier means with the first input receiving amplitude information and the second input receiving digital modulating signals synchronized to said scanning means.

10. An electronic musical instrument comprising:

means for producing note frequency selection signals, a plurality of channel means, fewer in number than the number of note frequencies available for selection, first memory means containing a plurality of channel address code words denoting corresponding said plurality of channel means available to be assigned to said note frequency selection signals, second memory means containing said channel address code words denoting said channel means assigned to associated said note frequency selection signals, means for producing note initiation signals, means for producing note null signals, and memory interchange means for transferring said channel address code words from said first memory means to said second memory means in response to said note initiation signals and transferring said channel address code words from said second memory means to said first memory means in response to said note null signals.

11. An electronic musical instrument as defined in claim 10 wherein said first memory means is accessed as a stack memory.

12. An electronic musical instrument as defined in claim 10 wherein each assigned said channel address code word is stored at a location corresponding to its assigned said note frequency selection signal.

13. An electronic musical instrument as defined in claim 10 further comprising:

means for producing note release phase signals, and re-key means responsive to said note release phase signals to prevent the reassignment of different said channel means when associated said note initiation signals are present.

14. An electronic musical instrument as defined in claim 10 further comprising:

means for producing note release phase signals, first means for producing a signal that indicates when no said channel means are available, and means responsive to the concurrence of both said note initiation signal and said signal produced by said first means for reassigning said channel means assigned to the said note frequency selection signal of the highest frequency having an associated said note release phase signal.

15. An electronic musical instrument as defined in claim 10 further comprising:

means for producing note release phase signals, and means responsive to said note initiation signals for reassigning said channel means associated with the said note release phase signal occuring latest in time to said note initiation signals.

16. An electronic musical instrument as defined in claim 15 wherein said first memory means is accessed as a stack memory.

17. An electronic musical instrument having envelope means for the production of a plurality of multiphase envelope signals for an associated plurality of channel means with said envelope means comprising:

a plurality of phase source means each being adjustable to effect envelope signal phase parameters commonly for all of said plurality of channel means, multiplexer means having said plurality of phase source means connected to its inputs, demultiplexer means having holding capacitors at each of its outputs with said demultiplexer outputs associated with said plurality of channel means and the input of said demultiplexer means connected to the output of said multiplexer means, control means functioning in a time division multiplex manner to develope continuous said envelope signals at said demultiplexer outputs, memory means responsive to note initiation signals and note release signals with said memory means containing envelope phase information for said plurality of channel means, and means to sequence phases of said plurality of multiphase envelope signals.

18. An electronic musical instrument as defined in claim 17 wherein said control means consists of a periodic plurality of channel address code words controlling said demultiplexer means and said memory means.

* * * * *